US011426048B2

(12) United States Patent
Fang

(10) Patent No.: US 11,426,048 B2
(45) Date of Patent: Aug. 30, 2022

(54) AUTOMATED FLOOR CLEANING APPARATUS

(71) Applicant: NINGBO FUJIA INDUSTRIAL CO., LTD., Ningbo (CN)

(72) Inventor: Jianqiang Fang, Ningbo (CN)

( * ) Notice: Subject to any disclaimer, the term of this patent is extended or adjusted under 35 U.S.C. 154(b) by 432 days.

(21) Appl. No.: 16/718,204

(22) Filed: Dec. 18, 2019

(65) Prior Publication Data

US 2020/0196817 A1 Jun. 25, 2020

(30) Foreign Application Priority Data

Dec. 21, 2018 (CN) ..... 201811569478.0

(51) Int. Cl.

| | |
|---|---|
| ***A47L 11/30*** | (2006.01) |
| ***A47L 11/24*** | (2006.01) |
| ***A47L 11/40*** | (2006.01) |

(52) U.S. Cl.

CPC ..... *A47L 11/302* (2013.01); *A47L 11/24* (2013.01); *A47L 11/307* (2013.01); *A47L 11/4002* (2013.01); *A47L 11/4011* (2013.01); *A47L 11/4016* (2013.01); *A47L 11/4041* (2013.01); *A47L 11/4047* (2013.01); *A47L 11/4083* (2013.01); *A47L 11/4088* (2013.01); *A47L 2201/06* (2013.01)

(58) Field of Classification Search

CPC ..... A47L 11/302; A47L 11/24; A47L 11/307; A47L 11/4002; A47L 11/4011; A47L 11/4016; A47L 11/4041; A47L 11/4047; A47L 11/4083; A47L 11/4088; A47L 2201/06; A47L 2201/028; A47L 11/4091; A47L 11/282; A47L 11/40; A47L 11/4072; A47L 2201/00

See application file for complete search history.

(56) References Cited

FOREIGN PATENT DOCUMENTS

WO WO-2005055795 A1 * 6/2005 ..... A47L 11/24

* cited by examiner

*Primary Examiner* — David Redding

(74) *Attorney, Agent, or Firm* — Bayramoglu Law Offices LLC

(57) ABSTRACT

The present disclosure discloses an automated floor cleaning apparatus, has an automatic cleaning robot and a washing base; the rear end of the robot body of the automatic cleaning robot is provided with a mop mechanism, the mop mechanism comprises a rotation component rotatably connected to the robot body and a crawler-type wiping cloth sleeving outside and rotating along with the rotation component. The invention provides can automatically and effectively removes dirt attached to the crawler-type wiping cloth, avoiding artificial detaching and then cleaning the wiping cloth stained with dirt, automatically performing washing operation, greatly alleviating operation burden of a user, and having a good floor sweeping effect.

20 Claims, 13 Drawing Sheets

AUTOMATED FLOOR CLEANING APPARATUS

CROSS-REFERENCE TO RELATED APPLICATIONS

This application claims priority to Chinese Patent Application No. 201811569478.0 with a filing date of Dec. 21, 2018. The content of the aforementioned application, including any intervening amendments thereto, are incorporated herein by reference.

TECHNICAL FIELD

The present disclosure relates to the technical field of automatic cleaning apparatuses, in particular to an automated floor cleaning apparatus.

BACKGROUND

With functions of automatic floor sweeping, dust collection and the like, a robot sweeper has been more and more widely used in our family. However, it is often troubled by that a wiping cloth of the existing robot sweeper is incapable of perfectly cleaning the floor due to only contacting the floor all along, and is inconvenient to clean for need of artificial assembly and disassembly, which therefore increases the cleaning burden of a user. But if the wiping cloth is not cleaned, the dirty wiping cloth will be continuously used by the robot sweeper to sweep the floor, causing secondary pollution.

SUMMARY

Regarding the abovementioned problems of the prior art, the present disclosure provides an automated floor cleaning apparatus capable of automatically removing dirt attached to a wiping cloth, for the purpose of overcoming the foregoing technical defects.

The specific technical solution is as follows:

An automated floor cleaning apparatus, comprises an automatic cleaning robot and a washing base; the rear end of the robot body of the automatic cleaning robot is provided with a mop mechanism, the mop mechanism comprises a rotation component rotatably connected to the robot body and a crawler-type wiping cloth sleeving outside and rotating along with the rotation component; the washing base comprises an outer container having an opening at its front side for the crawler-type wiping cloth to stretch in, a water supply mechanism with its water outlet facing the side of the crawler-type wiping cloth that stretches inside the opening, and a cleaning brush that is arranged inside the outer container and abuts against one side of the crawler-type wiping cloth that stretches inside the opening so as to remove dirt attached to the crawler-type wiping cloth through friction.

Preferably, the cleaning brush is a hair-planted rolling brush that is rotatably mounted inside the outer container and is in transmission connection with a first drive motor in the outer container; or the cleaning brush is a hair-planted scrubbing brush that is comprised by a plate secured inside the outer container and a bristle group at the front side of the plate, and the bristle group abuts against the front end of the crawler-type wiping cloth stretching into the outer container.

Preferably, an inner case is secured in the outer container, both the cleaning brush and the first drive motor are mounted on the inner case, and one side of the inner case has an outlet opposite to the opening.

Preferably, the front side of the outer container is also provided with a dehumidifying component that consists of a base connected to the front side of the outer container and arranged below the back of the crawler-type wiping cloth that stretches inside the opening, a dehumidifying nozzle is arranged on the base and communicated with an inlet end of vacuum equipment inside the outer container via a pipeline so as to form a negative pressure on the opening at the upper end of the dehumidifying nozzle and further absorb residual water stain in the crawler-type wiping cloth.

Preferably, a blow drying nozzle is also arranged at the front side of the dehumidifying nozzle, on the base. The blow drying nozzle is communicated with an air outlet of a hot-air blower in the outer container via a pipeline for drying the crawler-type wiping cloth.

Preferably, the water outlet of the water supply mechanism is connected with a washing nozzle that is of a hollow elongated structure as a whole, the lower end of the washing nozzle is provided with a strip-shaped water hole or a plurality of arrayed water ducts, and the washing nozzle is secured on the inner case.

Preferably, the outer container is also internally provided with a water tank and a controller, the inner bottom of the inner case is communicated with the water tank via a water suction pump for pumping out waste water retaining on the inner bottom of the inner case, the outlet end of the vacuum equipment is communicated with the water tank via a pipeline, the water supply mechanism is communicated with the washing nozzle via a booster pump or a magnetic valve, and the water suction pump, the vacuum equipment, the booster pump or the magnetic valve, and the hot-air blower are electrically connected with the controller respectively.

Preferably, the water tank comprises a clear water tank and a waste water tank, the water supply mechanism serves as the clear water tank connected to the washing nozzle via the booster pump, and both the water suction pump and the vacuum equipment are connected to the waste water tank; or the water supply mechanism is a tap faucet that is connected to the washing nozzle via the magnetic valve.

Preferably, the mop mechanism further comprises a mount support in the robot body, the rotation component is rotatably arranged in the mount support, a second drive motor for driving the rotation component to rotate is further arranged on the mount support, and the robot body is internally provided with a lifting mechanism for driving the mount support to ascend and descend.

Preferably, the rotation component comprises a drive wheel and a driven wheel that can be rotatably arranged in the mount support, the output shaft of the second drive motor is in transmission connection with one end of the drive wheel, and the crawler-type wiping cloth sleeves outside both the drive wheel and the driven wheel.

Preferably, the lifting mechanism also comprises a third drive motor secured in the robot body and a push rod sleeving the output shaft of the third drive motor, an overall portal-shaped curved plate is arranged on the mount support, the push rod stretches into the curved plate and lifts the mount support under the effect of the third drive motor.

Preferably, two ends of the drive wheel extend out of two sides of the mount support separately and are rotatably connected to the inside of the robot body, and the drive wheel is at the front side of the driven wheel.

Preferably, outside both the drive wheel and the driven wheel, a rubber drive belt sleeves, and the crawler-type wiping cloth sleeves outside the rubber drive belt.

Preferably, the crawler-type wiping cloth is strip-shaped, with its two ends each provided with a connection structure capable of being connected into a whole.

Preferably, an ultraviolet light source is mounted at one side, facing to the crawler-type wiping cloth, on the mount support, and used for performing further sterilization operation on the crawler-type wiping cloth.

Preferably, two ends of a center shaft of the drive wheel extend out of the mount support and are rotatably connected to a sliding seat respectively, each sliding seat is horizontally provided with a channel in which a guide rod is arranged in a penetrated mode, two ends of the guide rod are secured in the robot body, a fifth drive motor for driving the mount support to reciprocate front and back along the guide rod is also arranged in the robot body, and the output shaft of the fifth drive motor is in transmission connection with the front end of the mount support.

Preferably, the driven wheel has a hollow inside structure and a sixth drive motor is secured in the driven wheel, an eccentric block is arranged on the output shaft of the sixth drive motor in a sleeved mode to drive the driven wheel to wholly vibrate by virtue of eccentric inertia produced when the sixth drive motor drives the eccentric block to rotate.

Preferably, an electric brush plate is also received in the driven wheel, two round carbon rings serving as positive and negative poles are printed on the electric brush plate, positive and negative terminals at the rear end of the sixth drive motor respectively abut against the two round carbon rings, the electric brush plate is suspended inside the driven wheel through a strut, one end away from the electric brush plate of the strut extends out through the central through hole of the driven wheel and is secured on the mount support, the two round carbon rings of the electric brush plate extend out of the driven wheel along the strut via leads and are electrically connected with a central control system of the robot body.

The above technical solution has the following beneficial effects:

An automated floor cleaning apparatus comprises an automatic cleaning robot and a washing base, the automatic cleaning robot comprises a robot body capable of realizing automatic walking and automatic floor cleaning and a crawler-type mop mechanism, the washing base comprises an outer container, a water supply mechanism and a cleaning brush, therefore, the robot body of the automatic cleaning robot automatically walks to the washing base, after the crawler-type wiping cloth stretches in from the opening and abuts against the cleaning brush, the water outlet of the water supply mechanism sprays water to the crawler-type wiping cloth, the crawler-type wiping cloth rotates and rubs with the cleaning brush, thereby automatically and effectively removing dirt attached to the crawler-type wiping cloth, avoiding artificial detaching and then cleaning the wiping cloth stained with dirt, automatically performing washing operation, greatly alleviating operation burden of a user, and having a good floor sweeping effect.

DETAILED DESCRIPTION OF THE EMBODIMENTS

Figure 1:
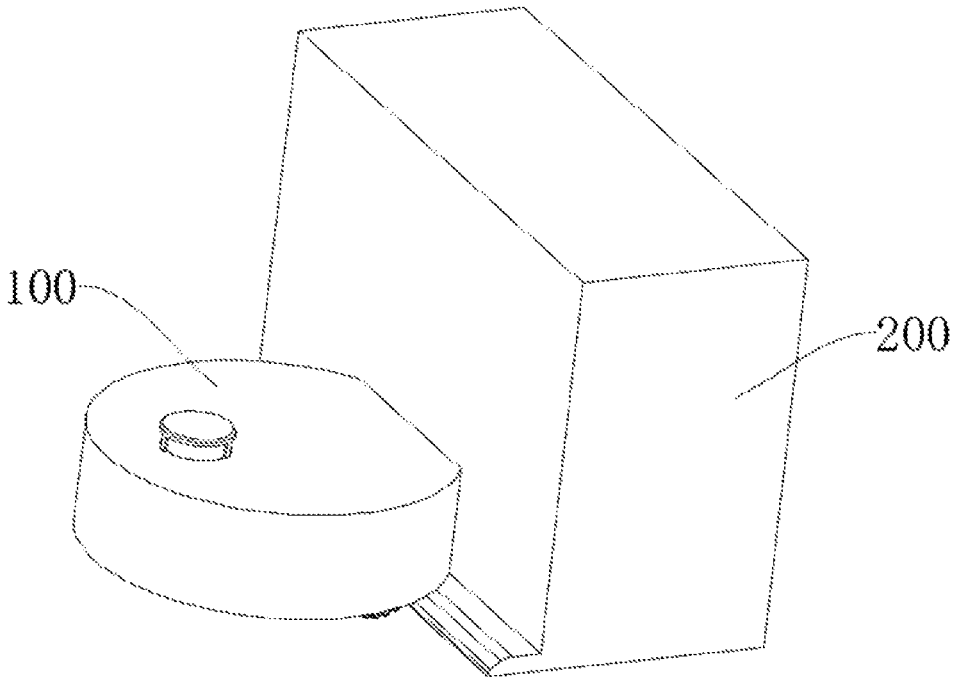
FIG. 1 is a stereogram of an automated floor cleaning apparatus of the present disclosure in Embodiment One.
Figure 2:
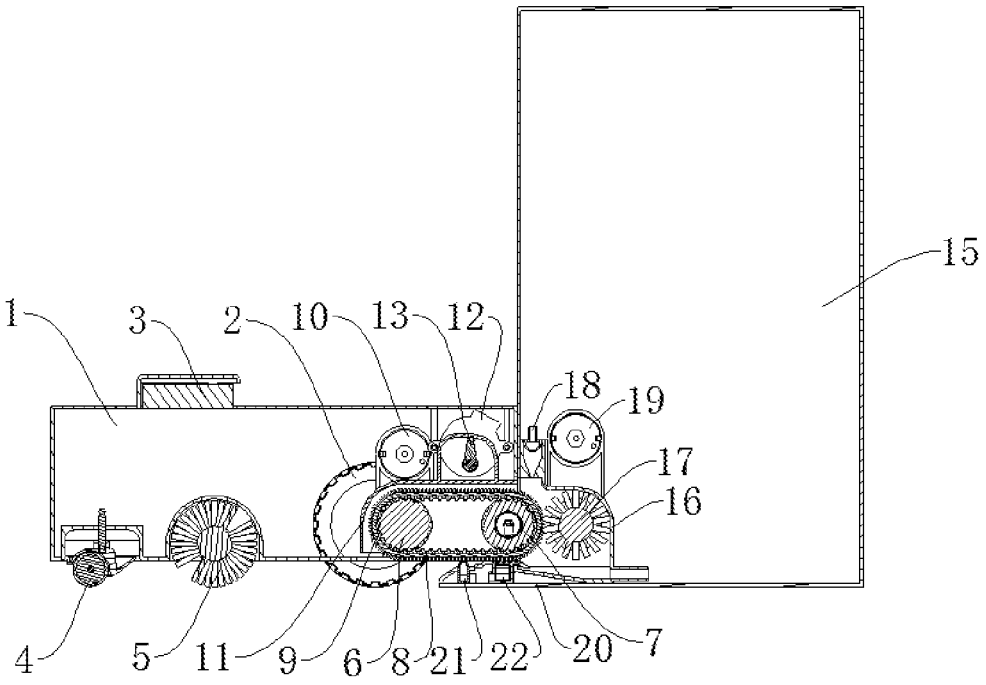
FIG. 2 is a sectional view of the automated floor cleaning apparatus of the present disclosure in Embodiment One.

For better illustrating the technical means, creative features, objects and effects of the present disclosure, detailed description will be given for the automated floor cleaning apparatus provided by the present disclosure with reference to the appended drawings (i.e., FIGS. 1-13). In addition, the left-to-right direction as shown in the paper face in FIG. 2 is defined as the front-to-back direction of the present disclosure.

Embodiment One

Referring to FIGS. 1-6, the automated floor cleaning apparatus provided by this embodiment comprises an automatic cleaning robot 100 and a washing base 200; the rear end of the robot body 1 of the automatic cleaning robot 100 is provided with a mop mechanism 110, the mop mechanism 110 comprises a rotation component rotatably connected to the robot body 1 and a crawler-type wiping cloth 9 sleeving outside and rotating along with the rotation component; the washing base 200 comprises an outer container 15 having an opening at its front side for the crawler-type wiping cloth 9 to stretch in, a water supply mechanism with its water outlet dead against one side behind the opening for the crawler-type wiping cloth 9 to stretch in, and a cleaning brush that is arranged inside the outer container 15 and abuts against one side of the opening for the crawler-type wiping cloth 9 to stretch in so as to remove dirt attached to the crawler-type wiping cloth 9 through friction.

Based on the above technical solution, an automated floor cleaning apparatus comprises an automatic cleaning robot 100 and a washing base 200, the automatic cleaning robot 100 comprises a robot body 1 capable of realizing automatic walking and automatic floor cleaning and a crawler-type mop mechanism 110, the washing base 200 comprises an outer container 15, a water supply mechanism and a cleaning brush, therefore, the robot body 1 of the automatic cleaning robot 100 automatically walks to the washing base 200, after the crawler-type wiping cloth 9 stretches into from the opening and abuts against the cleaning brush, the water outlet of the water supply mechanism sprays water to the crawler-type wiping cloth 9, the crawler-type wiping cloth 9 rotates and rubs with the cleaning brush, thereby automatically and effectively removing dirt attached to the crawler-type wiping cloth 9, avoiding artificial detaching and then cleaning the wiping cloth stained with dirt, automatically performing washing operation, greatly alleviating operation burden of a user, and having a good floor sweeping effect.

Figure 3:
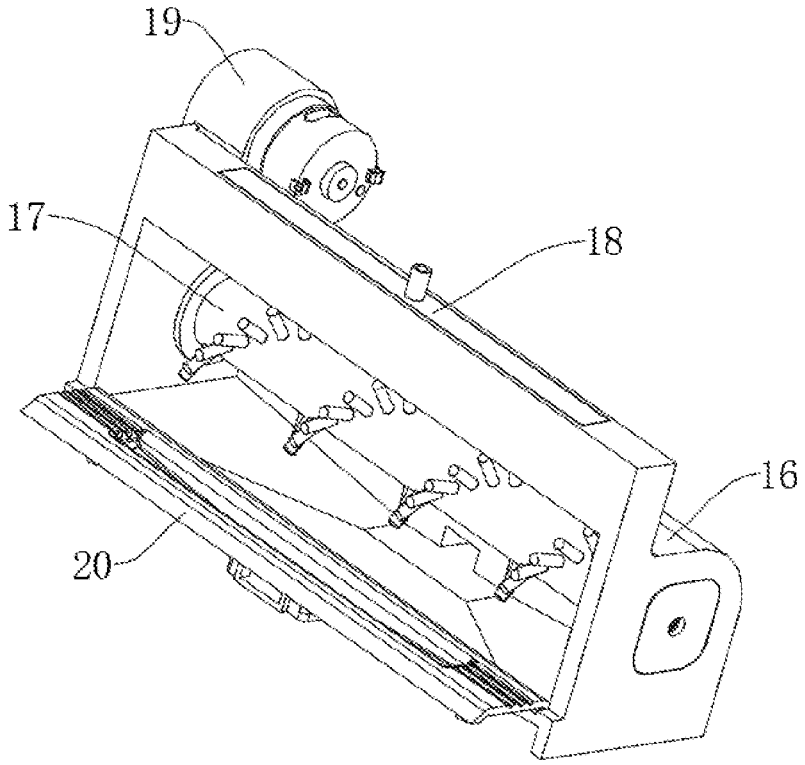
FIG. 3 is a stereogram of an inner structure of a washing base of the automated floor cleaning apparatus of the present disclosure in Embodiment One.
Figure 4:
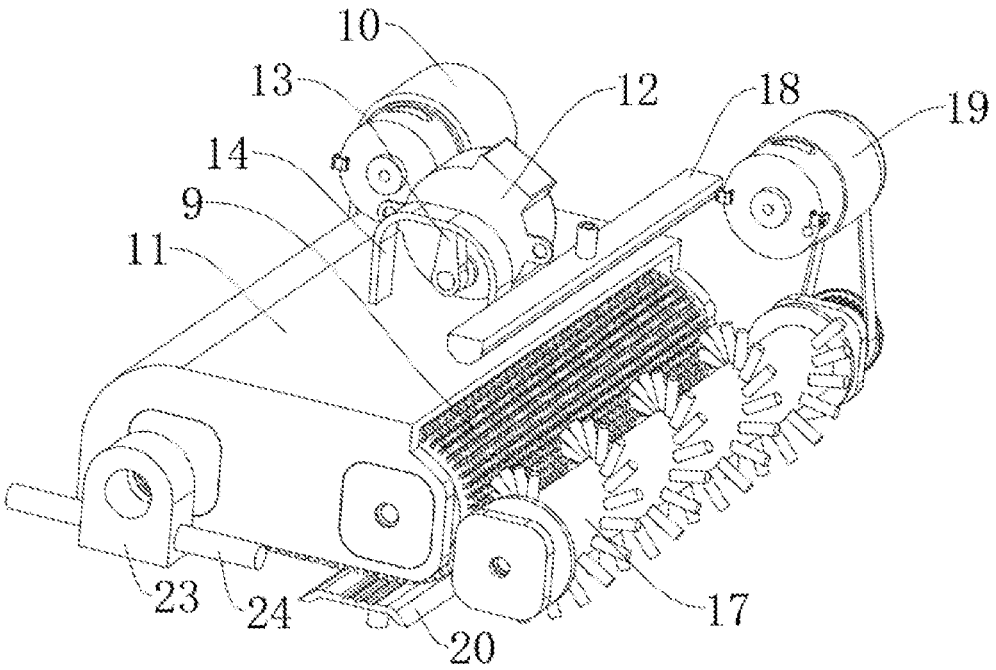
FIG. 4 is a stereogram of internal parts at a specific operating state of the automated floor cleaning apparatus of the present disclosure in Embodiment One.

In a preferred embodiment, as shown in FIGS. 2-4, the cleaning brush is a hair-planted rolling brush 17 that is rotatably mounted inside the outer container 15 and is in transmission connection with a first drive motor 19 in the outer container 15. An inner case 16 is secured in the outer container 15, both the cleaning brush and the first drive motor 19 are mounted on the inner case 16, and one side of the inner case 16 has an outlet opposite to the opening. To be specific, the hair-planted rolling brush 17 is rotatably connected to the inside of the inner case 16 via a rotary shaft, one end of the rotary shaft extends out of the inner case 16 and is sheathed with a belt pulley, the first drive motor 19 is secured outside the inner case 16, the output shaft is sheathed with another belt pulley, and the two belt pulleys are in transmission connection via a drive belt to achieve the driving purpose.

Figure 11:
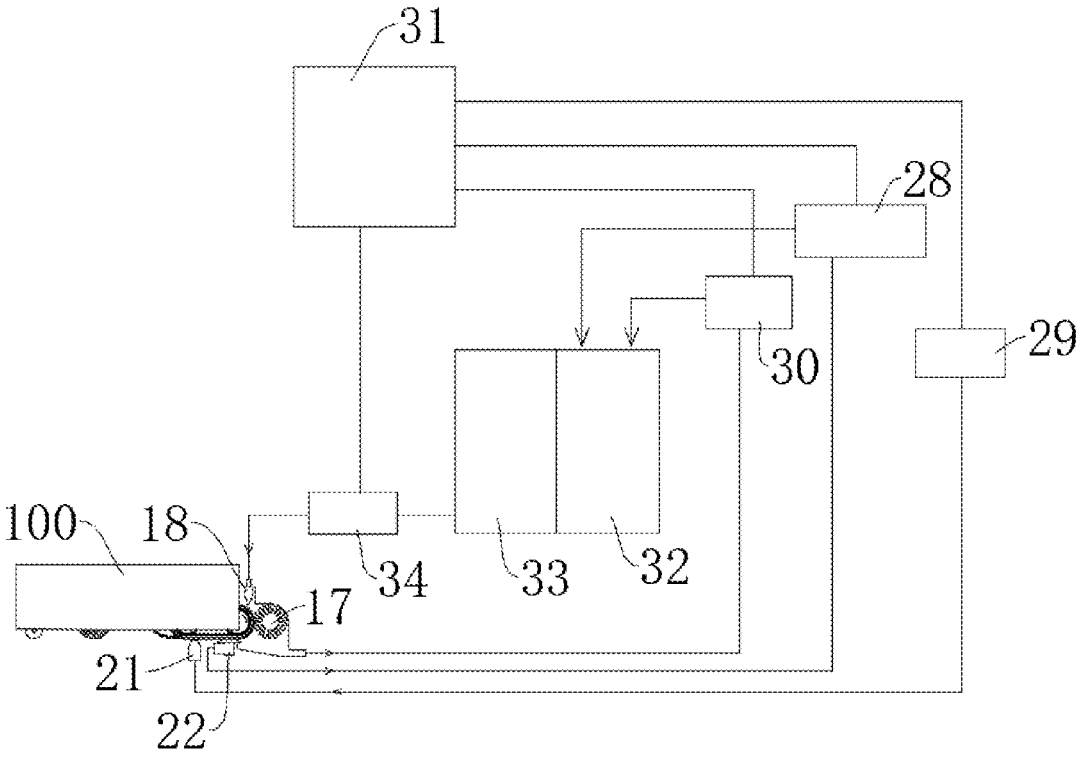
FIG. 11 is a water-electricity schematic diagram I of the automated floor cleaning apparatus of the present disclosure in performing cleaning operation.
Figure 12:
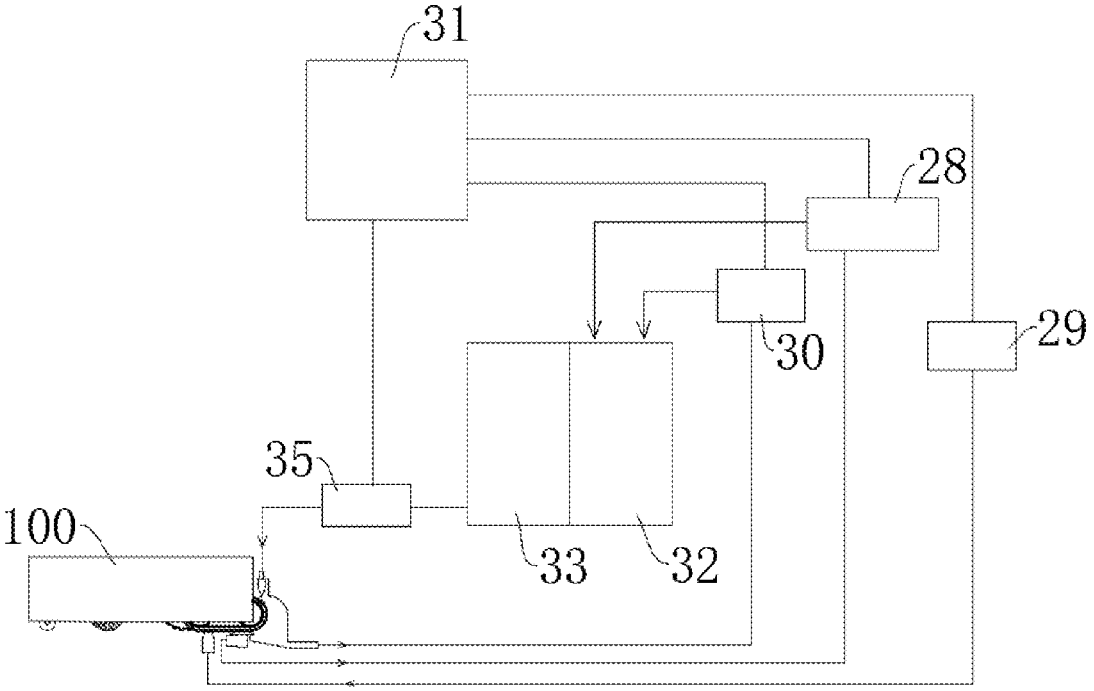
FIG. 12 is a water-electricity schematic diagram II of the automated floor cleaning apparatus of the present disclosure in performing cleaning operation.
Figure 13:
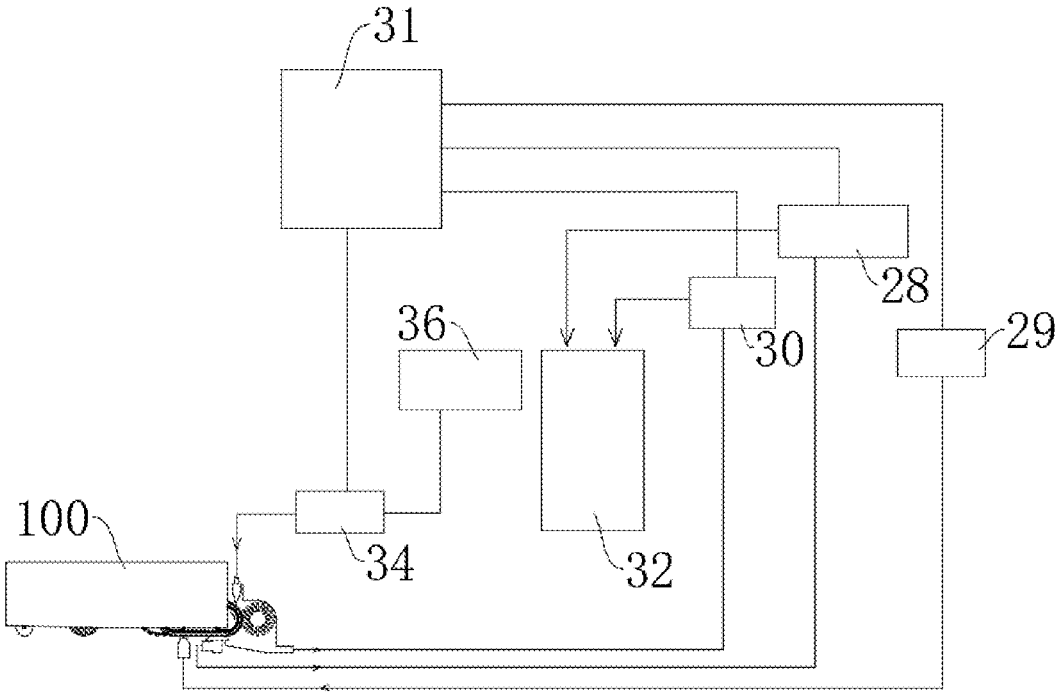
FIG. 13 is a water-electricity schematic diagram III of the automated floor cleaning apparatus of the present disclosure in performing cleaning operation.

As a further preferred embodiment, in combination with FIGS. 11-13, the front side of the outer container 15 is also provided with a dehumidifying component that consists of a base 20 connected to the front side of the outer container 15 and arranged below the back of the opening for the crawler-type wiping cloth 9 to stretch in, a dehumidifying nozzle 22 is arranged on the base 20 and communicated with an inlet end of vacuum equipment 28 inside the outer container 15 via a pipeline so as to form a negative pressure on the opening at the upper end of the dehumidifying nozzle 22 and further absorb residual water stain in the crawler-type wiping cloth 9. To be specific, the upper end face of the base 20 sinks inward to form a cavity by which the dehumidifying nozzle 22 is formed, the cavity and the inlet end of the vacuum equipment 28 inside the outer container 15 are communicated via a pipeline so as to form a negative pressure in the cavity and absorb residual water stain in the crawler-type wiping cloth 9. Or, the residual water stain in the crawler-type wiping cloth 9 is removed by directly disposing a nozzle. To be specific, the vacuum equipment 28 selected from any of a vacuum suction pump, an extraction type fan, a mini-type water suction pump or a dry-wet vacuum cleaner blower may serve the above purpose. In addition, a channel communicated with the cavity is formed at the bottom or rear side of the base 20 to achieve pipeline connection. In this embodiment, the cavity is of a square horn-mouth shape as a whole so that its area gradually increases from the bottom up, therefore the dehumidifying effect is better. Further, the base 20 is connected to the front side of the inner case 16. A blow drying nozzle 21 is also arranged at the front side of the dehumidifying nozzle 22, on the base 20. The blow drying nozzle 21 is communicated with an air outlet of a hot-air blower 29 in the outer container 15 via a pipeline for drying the crawler-type wiping cloth 9. It should be noted that the dehumidifying nozzle 22 and the blow drying nozzle 21 are the same nozzle of which the outlet tail end is communicated with the vacuum equipment 28 and the hot-air blower 29 via a T-branch structure, and dehumidifying and blow drying operations are carried out at an interval.

In a preferred embodiment, as shown in FIGS. 2-4, the water outlet of the water supply mechanism is connected with a washing nozzle 18 that is of a hollow elongated structure as a whole, the lower end of the washing nozzle 18 is provided with a strip-shaped water hole or a plurality of arrayed water ducts. To be specific, the washing nozzle 18 is arranged above the back of the opening for the crawler-type wiping cloth 9 to stretch in. Obviously, the strip-shaped water hole or the plurality of arrayed water ducts is/are communicated with the inside of the washing nozzle 18, the upper end of the washing nozzle 18 is also provided with a hollow column connector for being connected with the water outlet pipeline of the water supply mechanism, and the hollow column connector is also communicated with the inside of the washing nozzle 18. The washing nozzle 18 is secured on the inner case 16 or directly suspended inside the outer container 15. As seen from FIGS. 11-13, the outer container 15 is internally provided with a water tank and a controller 31, the inner bottom of the inner case 16 is communicated with the water tank via a water suction pump 30 for pumping out waste water retaining on the inner bottom of the inner case 16, the outlet end of the vacuum equipment 28 is communicated with the water tank via a pipeline, the water supply mechanism is communicated with the washing nozzle 18 via a booster pump 35 or a magnetic valve 34, and the water suction pump 30, the vacuum equipment 28, the booster pump 35 or the magnetic valve 34, and the hot-air blower 29 are electrically connected with the controller 31 respectively. To be specific, the controller 31 is a PCB circuit board or a PLC controller and has programs for controlling operating states of the above electric parts. A detection device (e.g., an infrared sensor) for detecting that the crawler-type wiping cloth 9 not only stretches in but also is in place can be found in the outer container 15 for automatically controlling operating states of all parts. Further, the above water tank comprises a clear water tank 33 and a waste water tank 32, the water supply mechanism serves as the clear water tank 33 connected to the washing nozzle 18 via the booster pump 35, and both the water suction pump 30 and the vacuum equipment 28 are connected to the waste water tank 32; or the water supply mechanism is a tap faucet 36 that is connected to the washing nozzle 18 via the magnetic valve 34.

Figure 5:
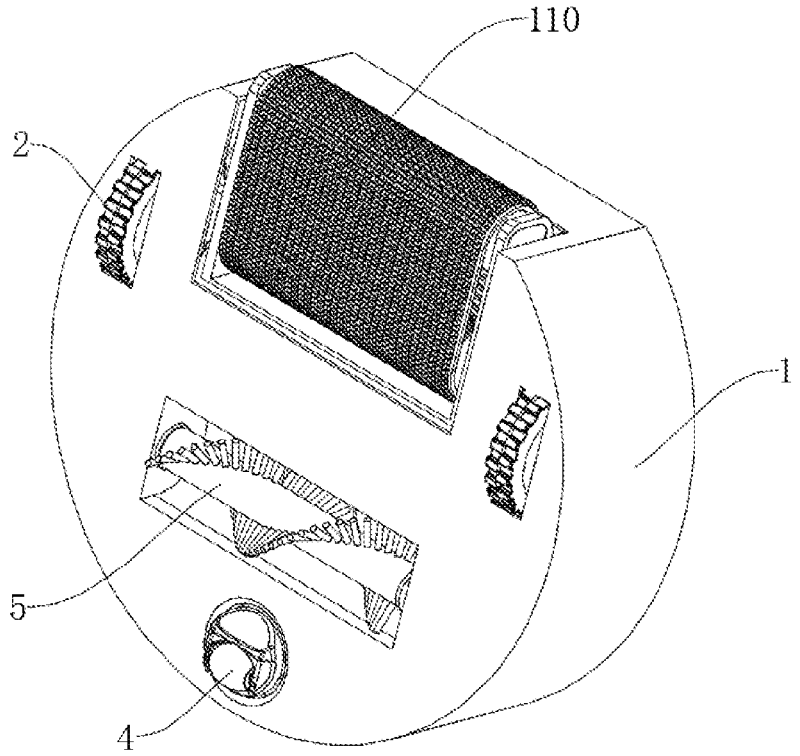
FIG. 5 is a stereogram of an automatic cleaning robot at the operating state I of the automated floor cleaning apparatus of the present disclosure in Embodiment One.
Figure 6:
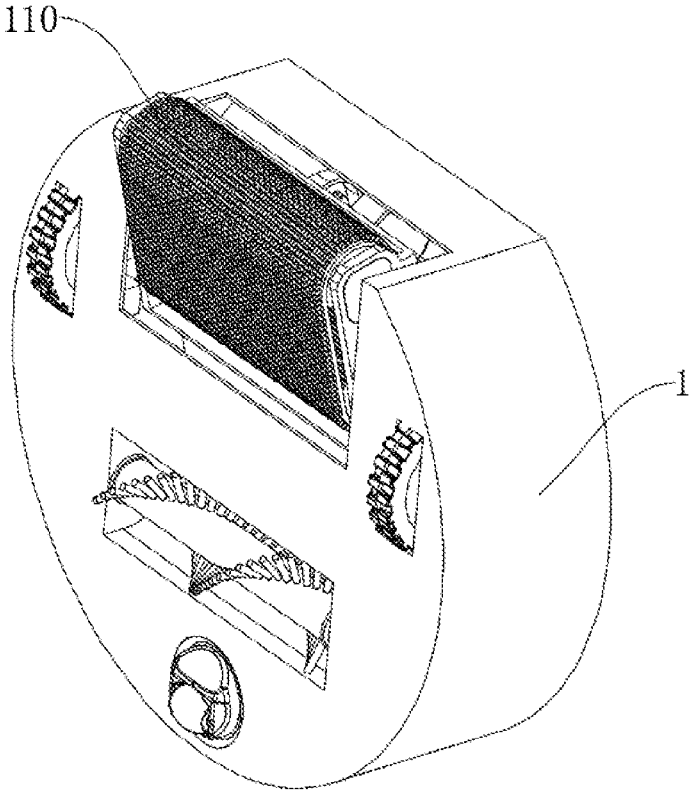
FIG. 6 is a stereogram of an automatic cleaning robot at the operating state II of the automated floor cleaning apparatus of the present disclosure in Embodiment One.

In a preferred embodiment, as shown in FIGS. 2, 5 and 6, the mop mechanism 110 further comprises a mount support 11 in the robot body 1, the rotation component is rotatably arranged in the mount support 11, a second drive motor 10 for driving the rotation component to rotate is further arranged on the mount support 11, and the robot body 1 is internally provided with a lifting mechanism for driving the mount support 11 to ascend and descend. Further, the rotation component comprises a drive wheel 6 and a driven wheel 7 that can be rotatably arranged in the mount support 11, the output shaft of the second drive motor 10 is in transmission connection with one end of the drive wheel 6, and the crawler-type wiping cloth 9 sleeves outside both the drive wheel 6 and the driven wheel 7. To be specific, transmission connection between the drive wheel 6 and the second drive motor 10 is realized by a belt pulley, a belt, or a gear set, which is not limited thereto. Further, the lifting mechanism also comprises a third drive motor 12 secured in the robot body 1 and a push rod 13 sleeving the output shaft of the third drive motor 12, an overall portal-shaped curved plate 14 is arranged on the mount support 11, the push rod 13 stretches into the curved plate 14 and lifts the mount support 11 under the effect of the third drive motor 12. In specific use, the output shaft of the third drive motor 12 drives the push rod 13 to rotate, lifts the mount support 11 when rotating in the curved plate 14 to be at the state shown in FIG. 4, and naturally lowers the mount support 11 under the effect of gravity when continuously rotating clockwise for 90° or more, thereby realizing ascending and descending. The above structure also can be directly realized by an electric push rod, which however is not limited thereto. Further, two ends of the drive wheel 6 extend out of two sides of the mount support 11 and are rotatably connected to the inside of the robot body 1, and the drive wheel 6 is at the front side of the driven wheel 7 so that the front end of the rotation component is pivotally connected in the robot body 1, while its rear end is a liftable free end, that is to say, the rear end of the mop mechanism 110 is liftable, with its liftable state shown in FIGS. 5-6. This is a more preferred solution in this embodiment, but actually, based on the above solution, an overall liftable structure is also permissible. Further, outside both the drive wheel 6 and the driven wheel 7, a rubber drive belt 8 sleeves, and the crawler-type wiping cloth 9 sleeves outside the rubber drive belt 8 to play a role in effective skid resistance. To be specific, the inner side wall of the rubber drive belt 8 constitutes the structure of an internal toothed belt, and the peripheries of the drive wheel 6 and the driven wheel 7 are provided with gear teeth matched with the structure of the internal toothed belt so as to further resist skidding. Further, the crawler-type wiping cloth 9 is strip-shaped, with its two ends each provided with a connection structure capable of being connected into a whole. This connection structure may refer to a hook and loop, zipper, velcro or the like. Based on the above structure, rapid assembly and disassembly of the crawler-type wiping cloth 9 mainly involve the following structures and steps: disposing a hook and hoop or forming a notch on the rubber drive belt 8 for insertion of one end of the crawler-type wiping cloth 9, inserting or bonding one end of the crawler-type wiping cloth 9 into the notch or on the hook and loop, driving the drive wheel 6 to rotate for a circle, connecting the other end of the crawler-type wiping cloth 9 to this end thereof into a whole, and sleeving the connected crawler-type wiping cloth 9 on the rubber drive belt 8. Its disassembly is carried out in a converse sequence, that is, disconnecting two ends of the crawler-type wiping cloth 9, directly taking out or taking out the crawler-type wiping cloth 9 by converse rotation of the drive wheel 6, therefore, assembly and disassembly are very easy. Further, an ultraviolet light source (not shown in the figures) is mounted at one side, facing to the crawler-type wiping cloth 9, on the mount support 11, and used for performing further sterilization operation on the crawler-type wiping cloth 9, especially after sweeping and cleaning operations, sterilization will be favorable of avoiding bacterial breeding in the long-term storage process. The ultraviolet light source is electrically connected with a central control system in the robot body 1.

As a more preferred embodiment, as shown in FIG. 4, two ends of a center shaft of the drive wheel 6 extend out of the mount support 11 and are rotatably connected to a sliding seat 23 respectively, each sliding seat 23 is horizontally provided with a channel in which a guide rod 24 is arranged in a penetrated mode, two ends of the guide rod 24 are secured in the robot body 1, a fifth drive motor (not shown in the figures) for driving the mount support 11 to reciprocate front and back along the guide rod 24 is arranged in the robot body 1, and the output shaft of the fifth drive motor is in transmission connection with the front end of the mount support 11, therefore, the effect is better in scrubbing the floor. To be specific, the fifth drive motor may be an electric push rod for directly driving the mount support 11 to reciprocate front and back. Or the fifth drive motor may be a common motor that is meshed with a spur rack and worm at the front side of the mount support 11 by virtue of a gear reduction unit and a drive gear in turn, which also makes linear movement come true.

Furthermore, the robot body 1 also has a radar device 3 for determining orientation and location, a universal wheel 4 for movement and two host bull wheels 2, a drive motor for driving the host bull wheels to operate, a central control system for controlling operating states of electric parts, a floor rolling brush 5 additionally mounted on the bottom of the robot body 1, and a charging module at one side of the junction of the robot body 1 and the washing base 200; the above electric parts are electrically connected with the central control system via leads to realize control. The above electric parts all belong to conventional parts of the existing robot sweeper, and fall into the scope of the prior art of this embodiment without any inventive step, therefore, detailed description about them are avoided, which however should not be deemed as the grounds that the present patent is not exploitable.

Embodiment Two

Figure 7:
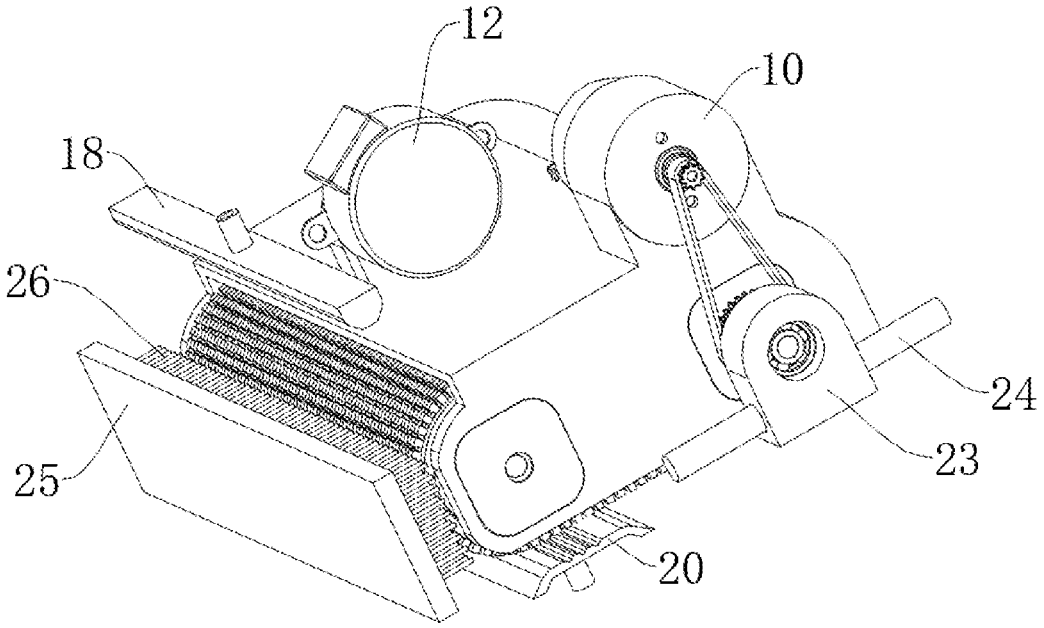
FIG. 7 is a stereogram of internal parts at a specific operating state of the automated floor cleaning apparatus of the present disclosure in Embodiment Two.

Referring to FIG. 7, the automated floor cleaning apparatus provided by this embodiment has the substantially same structure and contents to that in Embodiment One. The only difference lies in that in this embodiment, the cleaning brush is a hair-planted scrubbing brush that is comprised by a plate 25 secured inside the inner case 16 and a bristle group 26 at the front side of the plate 25; the bristle group 26 abuts against the front end of the crawler-type wiping cloth 9 after stretching into the inner case 16. In addition, the hair-planted scrubbing brush can be driven by a drive mechanism to move front and back or up and down to enhance the dirt removing effect.

Embodiment Three

Figure 8:
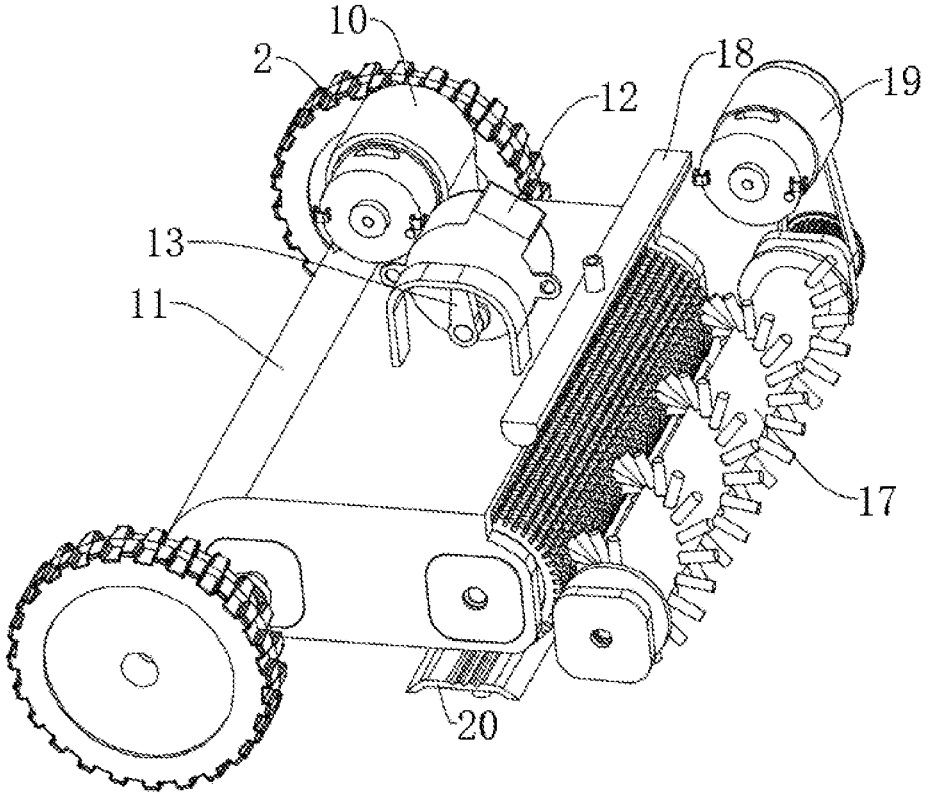
FIG. 8 is a stereogram of internal parts at a specific operating state of the automated floor cleaning apparatus of the present disclosure in Embodiment Three.
Figure 9:
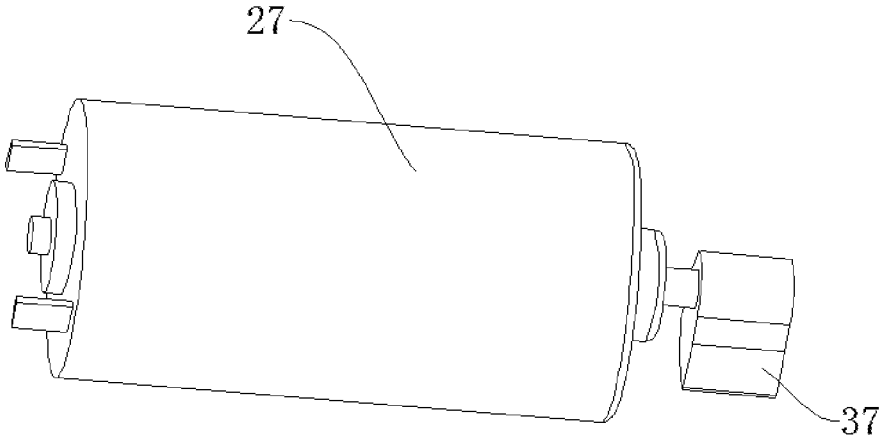
FIG. 9 is a stereogram of a vibration motor of the automated floor cleaning apparatus of the present disclosure in Embodiment Three.

Referring to FIGS. 8 and 9, the automated floor cleaning apparatus provided by this embodiment has the substantially same structure and contents to that in Embodiment One. The only difference lies in that in this embodiment, the driven wheel 7 has a hollow inside structure and a sixth drive motor 27 is secured in the driven wheel 7, an eccentric block 37 is arranged on the output shaft of the sixth drive motor 27 in a sleeved mode to drive the driven wheel 7 to wholly vibrate by virtue of eccentric inertia produced when the sixth drive motor 27 drives the eccentric block 37 to rotate, producing a good effect in scrubbing the floor. Further, an electric brush plate (not shown in the figures) is also received in the driven wheel 7, two round carbon rings serving as positive and negative poles are printed on the electric brush plate, positive and negative terminals at the rear end of the sixth drive motor 27 respectively abut against the two round carbon rings, the electric brush plate is suspended inside the driven wheel 7 through a strut, one end away from the electric brush plate of the strut extends out through the central through hole of the driven wheel 7 and is secured on the mount support 11, the two round carbon rings of the electric brush plate extend out of the driven wheel 7 along the strut via leads and are electrically connected with a central control system of the robot body 1 so as to electrify the sixth drive motor 27. Further, in this embodiment, the cleaning brush may be a hair-planted rolling brush 17 with its specific structure as same as to that described in Embodiment One, therefore repetition is avoided.

Embodiment Four

Figure 10:
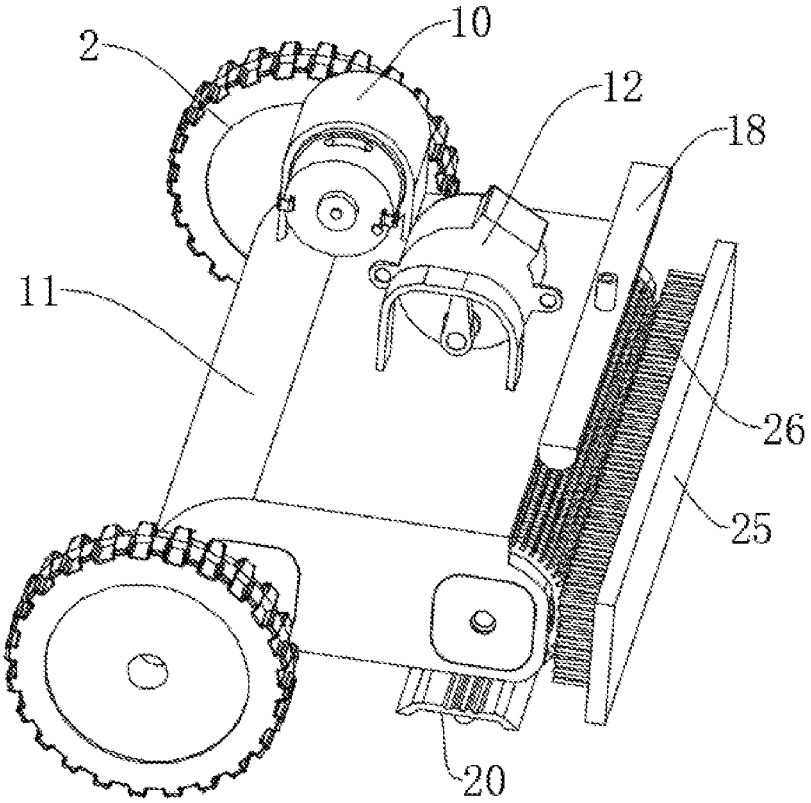
FIG. 10 is a stereogram of internal parts at a specific operating state of the automated floor cleaning apparatus of the present disclosure in Embodiment Four.

Referring to FIG. 10, the automated floor cleaning apparatus provided by this embodiment has the substantially same structure and contents to that in Embodiment Three. The only difference lies in that in this embodiment, the cleaning brush is a hair-planted scrubbing brush with the specific structure as same as to that described in Embodiment Two, therefore, repetition is avoided.

Embodiment Five

An automated floor cleaning apparatus according to any of Embodiments 1 to 4, which operates in two procedures, i.e., a floor sweeping procedure and a cleaning procedure; the floor sweeping procedure comprises: step a, driving a crawler-type wiping cloth 9 to descend by a third drive motor 12 in a robot body 1; step b, enabling the robot body 1 to move on the floor, and driving the crawler-type wiping cloth 9 to rotate and perform floor sweeping operation of the wiping cloth by a rotation component; and step c, after the crawler-type wiping cloth 9 rotates for a circle, driving the crawler-type wiping cloth 9 to ascend by the third drive motor 12, recording the location at this time by a central control system and a radar device 3 of the robot body 1 as a breakpoint position, and moving the crawler-type wiping cloth 9 toward a washing base 200 until it stretches into the washing base 200 and abuts against the cleaning brush to perform the cleaning procedure.

The cleaning procedure comprises the following steps: step I, spraying water to the crawler-type wiping cloth 9 from the water outlet of a water supply mechanism; step II, driving the crawler-type wiping cloth 9 to rotate by the rotation component, and rendering the crawler-type wiping cloth 9 and the cleaning brush rub with each other so as to remove dirt attached to the crawler-type wiping cloth 9; and step III, after the automatic cleaning robot performs cleaning operation for a preset period of time on the washing base 200, determining the orientation by the central control system and the radar device 3 of the robot body 1, and moving to the recorded breakpoint position to perform the floor sweeping procedure once again.

Based on the above technical solution, the automatic cleaning robot is capable of performing floor sweeping and wiping cloth cleaning operations, and in the floor sweeping procedure, the crawler-type wiping cloth 9 is used only for a circle and then enters an ascent state in the moving process, therefore, secondary pollution of the floor is effectively prevented, automation degree is high and floor sweeping and cleaning operations are convenient and reliable.

In a preferred embodiment, a step d may be added in step b: driving the crawler-type wiping cloth 9 to reciprocate front and back under the drive of the fifth drive motor in the robot body 1 to give a better floor sweeping effect.

In a preferred embodiment, a step e may be added in step b: driving a driven wheel 7 and the rear end of the crawler-type wiping cloth 9 to vibrate by the sixth drive motor 27 in the driven wheel 7 of the rotation component so as to give a better floor sweeping effect.

Additionally, in specific use, both in steps a and c, ascending and descending of the crawler-type wiping cloth 9 merely refer to the actions of the rear end of the crawler-type wiping cloth 9. Besides, the effects that the crawler-type wiping cloth 9 rotates for a circle and for the above preset period of time are realized depending on set parameters.

In a preferred embodiment, a dehumidifying step and a blow drying step may be added between steps II and III, and the dehumidifying step is: forming a negative pressure, by vacuum equipment 28, on the opening of a dehumidifying nozzle 22 via a pipeline, and adsorbing residual water stain in the crawler-type wiping cloth 9; the dehumidifying nozzle 22 is under the crawler-type wiping cloth 9. The blow drying step is: ejecting out hot air, by the hot-air blower 29, from the opening of the blow drying nozzle 21 via a pipeline, and drying the crawler-type wiping cloth 9 subjected to the cleaning and dehumidifying steps; the blow drying nozzle 21 is under the crawler-type wiping cloth 9.

The above merely provides the preferred embodiments of the present disclosure, which is illustrative, rather than restrictive, to the present disclosure. However, it should be understood by those skilled in the art that, many variations, modifications even substitutions that do not depart from the spirit and scope defined by the present disclosure, shall fall into the extent of protection of the present disclosure.

I claim:

1. An automated floor cleaning apparatus, comprising an automatic cleaning robot and a washing base, wherein the rear end of the robot body of the automatic cleaning robot is provided with a mop mechanism, the mop mechanism comprises a rotation component rotatably connected to the robot body and a crawler-type wiping cloth sleeving outside and rotating along with the rotation component; the washing base comprises:

an outer container having an opening at its front side for the crawler-type wiping cloth to stretch in, a water supply mechanism, with its water outlet facing the side of the crawler-type wiping cloth that stretches inside the opening, and a cleaning brush, arranged inside the outer container and abuts against the side of the crawler-type wiping cloth that stretches inside the opening so as to remove dirt attached to the crawler-type wiping cloth through friction.

2. The automated floor cleaning apparatus of claim 1, wherein the cleaning brush is a hair-planted rolling brush that is rotatably mounted inside the outer container and is in transmission connection with a first drive motor in the outer container.

3. The automated floor cleaning apparatus of claim 2, wherein an inner case is secured in the outer container, both the cleaning brush and the first drive motor are mounted on the inner case, and one side of the inner case has an outlet opposite to the opening.

4. The automated floor cleaning apparatus of claim 3, wherein the front side of the outer container is also provided with a dehumidifying component that consists of a base connected to the front side of the outer container and arranged below the back of the crawler-type wiping cloth that stretches inside the opening, a dehumidifying nozzle is arranged on the base and communicated with an inlet end of vacuum equipment inside the outer container via a pipeline so as to form a negative pressure on the opening at the upper end of the dehumidifying nozzle and further absorb residual water stain in the crawler-type wiping cloth.

5. The automated floor cleaning apparatus of claim 4, wherein a blow drying nozzle is also arranged at the front side of the dehumidifying nozzle, on the base. The blow drying nozzle is communicated with an air outlet of a hot-air blower in the outer container via a pipeline for drying the crawler-type wiping cloth.

6. The automated floor cleaning apparatus of claim 3, wherein the water outlet of the water supply mechanism is connected with a washing nozzle that is of a hollow elongated structure as a whole, the lower end of the washing nozzle is provided with a strip-shaped water hole or a plurality of arrayed water ducts, and the washing nozzle is secured on the inner case.

7. The automated floor cleaning apparatus of claim 5, wherein the outer container is also internally provided with a water tank and a controller, the inner bottom of the inner case is communicated with the water tank via a water suction pump for pumping out waste water retaining on the inner bottom of the inner case, the outlet end of the vacuum equipment is communicated with the water tank via a pipeline, the water supply mechanism is communicated with the washing nozzle via a booster pump or a magnetic valve, and the water suction pump, the vacuum equipment, the booster pump or the magnetic valve, and the hot-air blower are electrically connected with the controller respectively.

8. The automated floor cleaning apparatus of claim 7, wherein the water tank comprises a clear water tank and a waste water tank, the water supply mechanism serves as the clear water tank connected to the washing nozzle via the booster pump, and both the water suction pump and the vacuum equipment are connected to the waste water tank.

9. The automated floor cleaning apparatus of claim 1, wherein the mop mechanism further comprises a mount support in the robot body, the rotation component is rotatably arranged in the mount support, a second drive motor for driving the rotation component to rotate is further arranged on the mount support, and the robot body is internally provided with a lifting mechanism for driving the mount support to ascend and descend.

10. The automated floor cleaning apparatus of claim 9, wherein the rotation component comprises a drive wheel and a driven wheel that can be rotatably arranged in the mount support, the output shaft of the second drive motor is in transmission connection with one end of the drive wheel, and the crawler-type wiping cloth sleeves outside both the drive wheel and the driven wheel.

11. The automated floor cleaning apparatus of claim 9, wherein the lifting mechanism also comprises a third drive motor secured in the robot body and a push rod sleeving the output shaft of the third drive motor, an overall portal-shaped curved plate is arranged on the mount support, the push rod stretches into the curved plate and lifts the mount support under the effect of the third drive motor.

12. The automated floor cleaning apparatus of claim 10, wherein two ends of the drive wheel extend out of two sides of the mount support separately and are rotatably connected to the inside of the robot body, and the drive wheel is at the front side of the driven wheel.

13. The automated floor cleaning apparatus of claim 12, wherein a rubber drive belt sleeves outside both the drive wheel and the driven wheel, and the crawler-type wiping cloth sleeves outside the rubber drive belt.

14. The automated floor cleaning apparatus of claim 13, wherein the crawler-type wiping cloth is strip-shaped, with its two ends each provided with a connecting structure to be connected into a whole.

15. The automated floor cleaning apparatus of claim 9, wherein an ultraviolet light source is mounted at one side, facing to the crawler-type wiping cloth, on the mount support, and used for performing further sterilization operation on the crawler-type wiping cloth.

16. The automated floor cleaning apparatus of claim 10, wherein two ends of a center shaft of the drive wheel extend out of the mount support and are rotatably connected to a sliding seat respectively, each sliding seat is horizontally provided with a channel in which a guide rod is arranged in a penetrated mode, two ends of the guide rod are secured in the robot body, a fifth drive motor for driving the mount support to reciprocate front and back along the guide rod is also arranged in the robot body, and the output shaft of the fifth drive motor is in transmission connection with the front end of the mount support.

17. The automated floor cleaning apparatus of claim 10, wherein the driven wheel has a hollow inside structure and a sixth drive motor is secured in the driven wheel, an eccentric block is arranged on the output shaft of the sixth drive motor in a sleeved mode to drive the driven wheel to wholly vibrate by virtue of eccentric inertia produced when the sixth drive motor drives the eccentric block to rotate.

18. The automated floor cleaning apparatus of claim 17, wherein an electric brush plate is also received in the driven wheel, two round carbon rings serving as positive and negative poles are printed on the electric brush plate, positive and negative terminals at the rear end of the sixth drive motor respectively abut against the two round carbon rings, the electric brush plate is suspended inside the driven wheel through a strut, one end away from the electric brush plate of the strut extends out through the central through hole of the driven wheel and is secured on the mount support, the two round carbon rings of the electric brush plate extend out of the driven wheel along the strut via leads and are electrically connected with a central control system of the robot body.

19. The automated floor cleaning apparatus of claim 1, wherein the cleaning brush is a hair-planted scrubbing brush that is comprised by a plate secured inside the outer container and a bristle group at the front side of the plate, and the bristle group abuts against the front end of the crawler-type wiping cloth stretching into the outer container.

20. The automated floor cleaning apparatus of claim 6, wherein the outer container is also internally provided with a water tank and a controller, the inner bottom of the inner case is communicated with the water tank via a water suction pump for pumping out waste water retaining on the inner bottom of the inner case, the outlet end of the vacuum equipment is communicated with the water tank via a pipeline, the water supply mechanism is communicated with the washing nozzle via a booster pump or a magnetic valve, and the water suction pump, the vacuum equipment, the booster pump or the magnetic valve, and the hot-air blower are electrically connected with the controller respectively.

* * * * *